US005322153A

United States Patent [19]

Ibarrola et al.

[11] Patent Number: 5,322,153

[45] Date of Patent: Jun. 21, 1994

[54] PROCEDURE FOR DETECTING THE OPERATION OF THE COIN RETURN MECHANISM IN COIN SELECTORS

[75] Inventors: Jesús E. Ibarrola; José Insausti, both of Pamplona, Spain

[73] Assignee: Azkoyen Industrial, S. A., Peralta, Spain

[21] Appl. No.: 925,733

[22] Filed: Aug. 7, 1992

[30] Foreign Application Priority Data

Aug. 8, 1991 [ES] Spain ..... 9101858

[51] Int. Cl.[5] ..... G07D 5/08

[52] U.S. Cl. ..... 194/318; 194/345

[58] Field of Search ..... 194/317, 318, 345

[56] References Cited

U.S. PATENT DOCUMENTS

| | | | |
|---|---|---|---|
| 1,625,979 | 4/1927 | Brinkerhoff . | |
| 3,415,256 | 12/1968 | Meloni . | |
| 3,712,441 | 1/1973 | Taylor . | |
| 4,105,105 | 8/1978 | Braum . | |
| 4,263,924 | 4/1981 | Johnson . | |
| 4,503,961 | 3/1985 | Chittleborough . | |
| 4,650,057 | 3/1987 | Koester | 194/346 |
| 4,690,263 | 9/1987 | Yokomori | 194/345 X |
| 5,067,604 | 11/1991 | Metcalf | 194/317 X |

FOREIGN PATENT DOCUMENTS

| | | | |
|---|---|---|---|
| 0000010 | 12/1978 | European Pat. Off. . | |
| 0184393 | 6/1986 | European Pat. Off. . | |
| 0246993 | 11/1987 | European Pat. Off. | 194/318 |
| 0323396 | 7/1989 | European Pat. Off. . | |
| 0360506 | 3/1990 | European Pat. Off. . | |
| 603120 | 9/1934 | Fed. Rep. of Germany . | |
| 3009466 | 9/1981 | Fed. Rep. of Germany . | |
| 3512579 | 10/1986 | Fed. Rep. of Germany . | |
| 747958 | 6/1933 | France . | |
| 2293749 | 7/1976 | France . | |
| 8300400 | 2/1983 | PCT Int'l Appl. . | |
| 555181 | 5/1986 | Spain . | |
| 11006 | 8/1892 | United Kingdom . | |
| 1066389 | 4/1967 | United Kingdom . | |
| 1486519 | 9/1977 | United Kingdom . | |
| 2022897 | 12/1979 | United Kingdom . | |
| 2047936 | 12/1980 | United Kingdom . | |
| 2070307 | 9/1981 | United Kingdom . | |
| 2105893 | 3/1983 | United Kingdom . | |
| 2135094 | 8/1984 | United Kingdom . | |

*Primary Examiner*—F. J. Bartuska

*Attorney, Agent, or Firm*—Rothwell, Figg, Ernst & Kurz

[57] ABSTRACT

Procedure for detecting the operation of the coin return mechanism in coin selectors, especially in selectors having a passage through which the coins pass, which can be opened for the recovery thereof, and having at least one coin passage detector, the operating conditions of which are sensitive to the passage of the coins and to the opening of the passage. The procedure consists of detecting the alterations in the operating conditions of the said detector caused by the opening of the channel. These alterations result in changes of amplitude and frequency which are measured, for example, by the microprocessor of the selector, and differentiated from the alterations due to the passage of a coin.

5 Claims, 3 Drawing Sheets

PROCEDURE FOR DETECTING THE OPERATION OF THE COIN RETURN MECHANISM IN COIN SELECTORS

BACKGROUND OF THE INVENTION

This invention relates to a procedure for detecting the operation of the coin return mechanism in coin selectors, especially in selectors having a passage through which the coins pass.

Coin selector devices of the type indicated normally contain an inclined passage down which the coins roll, as illustrated in FIGS. 1, 2 and 3. Various types of sensors, generally optical, electromagnetic and capacitive, are placed in this channel for the purpose of detecting different features of the coin relating to its dimensions and alloys, which will then allow the validity of the coin to be known, leading to its acceptance or rejection. This channel has dimensions suitable for the maximum size of the permissible coins and under certain conditions, for example if two coins are inserted simultaneously, the passage can become blocked. It is therefore necessary to have a device which makes it possible to free the coins that are possibly stuck. Generally, the passage of the coin selectors is delimited by a fixed side and a mobile side, forming a gate, the opening or separation of the mobile side allowing access to the said passage. The movement of this gate or side is normally controlled by an operating lever. Actuation of this lever causes the opening of the gate and passage and, with it, the return of the blocked or stuck coins.

With the use of coin selector devices in automatic vending machines, it has been found useful for the machine, or where applicable the coin storage and return device, to receive a signal from the coin selector when the selector's coin return lever has been operated. This signal can be used, for example, to return the coins put into the machine and to zero the corresponding credit. The signal detecting the operation of the selector's coin return lever is currently generated by known methods such as microswitches, proximity detectors, reed contacts and opto-electronic barriers.

These systems, although valid, have the following disadvantages: they are costly, occupy a relatively large amount of space in the selector and need wiring and connectors.

SUMMARY OF THE INVENTION

The purpose of the present invention is to develop a procedure which allows the operation of the coin return mechanism to be detected while overcoming said disadvantages. According to the procedure of the invention it is not necessary to provide the selector with any additional or specific detector in order to obtain the said function, use being made of the selector's own sensors intended for the detection of coins.

The procedure of the invention is applicable to selectors which include at least one coin detector in the coin passage and is characterised by the fact that it consists of detecting the alterations in the operating conditions of the said detector caused by the opening of the channel, such alterations resulting in changes of amplitude or frequency which are measured by the microprocessor of the coin selector itself and which are differentiated from the changes caused by the passage of a coin. This detector can consist of an inductive sensor which produces electromagnetic signals.

Preferably the selector will have two or more detectors, one of them inductive and the others possibly of the optical type. With the existence of two or more detectors of the type indicated, the alteration of the operating conditions of the inductive sensor owing to the opening of the channel is conditioned by or combined with the alterations to the operation of at least a second detector, for example of optical type, which is sensitive to the passage of the coins but not to the opening of the channel, or at least to the initial opening thereof.

BRIEF DESCRIPTION OF THE DRAWINGS

The characteristics of the invention will be better understood from the following description, in which reference is made to the attached drawings where.

Figure 1:
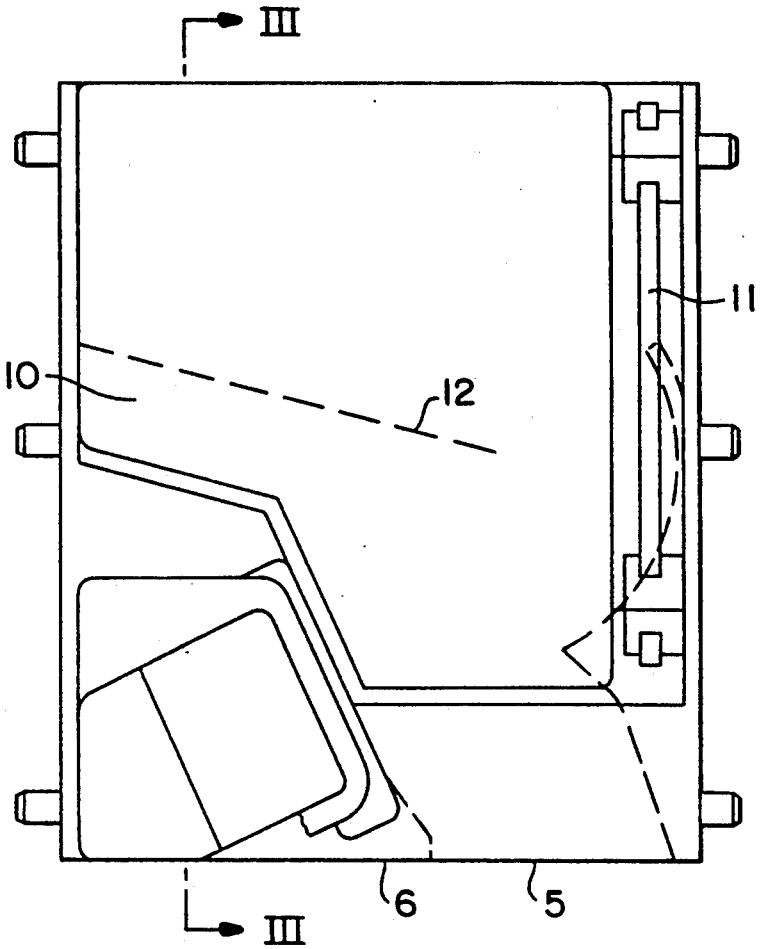
FIG. 1 PRIOR ART
FIG. 1 is a side view of a traditional coin selector.
Figure 2:
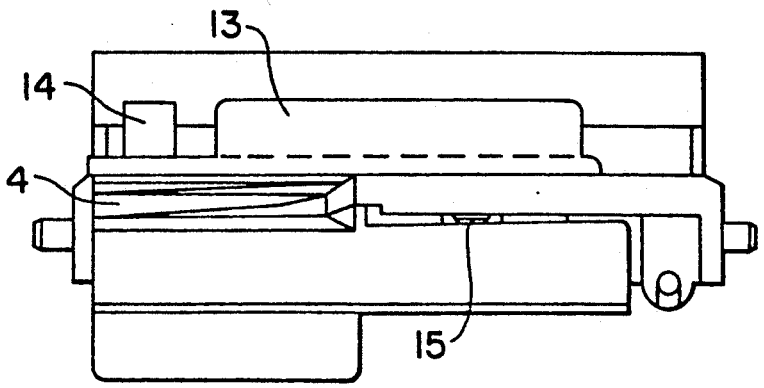
FIG. 2 PRIOR ART
FIG. 2 is a plan view of the top of the selector in FIG. 1.
Figure 3:
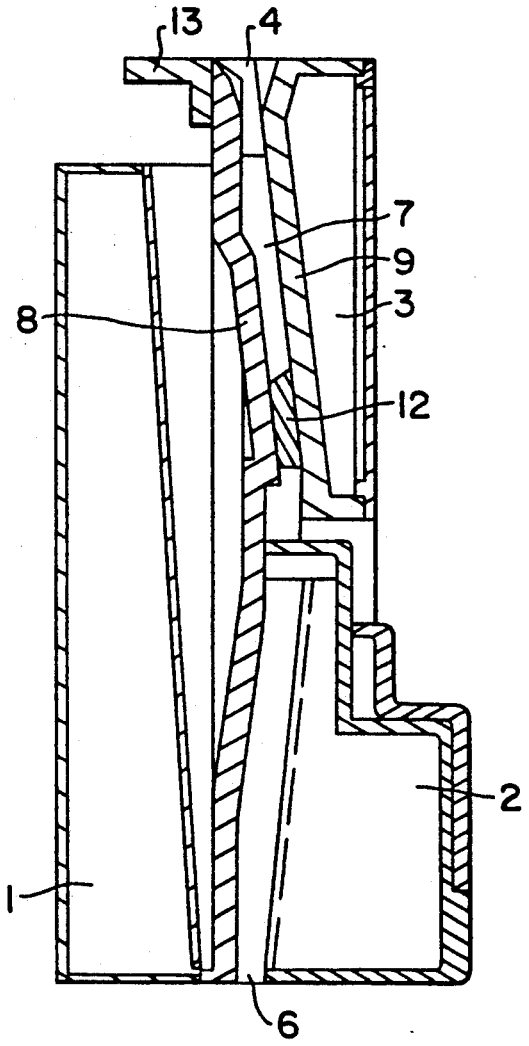
FIG. 3 PRIOR ART
FIG. 3 is a cross-section through line III—III in FIG. 1.

The selector illustrated in FIGS. 1, 2 and 3, of traditional composition, has a frame of approximately straight prismatic general configuration, of rectangular plan. This frame contains internal housings or compartments, referred to with the numbers 1, 2 and 3 in FIG. 3, in which the components and electronic circuits of the selector are installed. In addition, the selector has an opening 4 at the top, for the insertion of coins, and two exit openings at the bottom, shown by the numbers 5 and 6 in FIGS. 1 and 3. Between the upper coin insertion opening 4 and the bottom exit openings 5 and 6 there is a passage or channel 7, defining the track down which the coins inserted through opening 4 will roll.

The passage or channel 7 is delimited by two roughly parallel sides, one of them fixed and shown by the number 8 in FIG. 3 and the other one mobile and shown by the number 9. The mobile side 9 forms a gate 10, FIG. 1, which is articulated onto the frame by a pin 11. The channel or passage 7 is delimited at the bottom by a sloping rib 12, which can for example be integral with the mobile side 9, down which the coin will roll.

The mobile side 9 can rotate about the articulation pin 11, moving away from the fixed side 8 to allow the extraction of any coins which may have accidentally stuck. The rotation of the side 9 is generally achieved by a control or button acting on a lever 13, articulated to the frame by the pin 14, and having a pivot 15 which can be opposite a ramp or inclined plane, not shown in the drawings, on the inner surface of the mobile side 9.

With this composition, when the insertion of the coins causes them to become stuck inside the selector, it is possible by pressing the button of the machine to operate the lever 13, which causes the mobile side 9 to rotate and separate from the fixed side 8 by a sufficient amount to allow the coins to drop into the return channel.

The composition described corresponds to that of various coin selectors existing on the market.

Channel 7 through which the coins will pass normally contains various types of sensor allowing particular features of the coins to be determined, so that the validity thereof can be assessed, leading to their acceptance or rejection.

Figure 4:
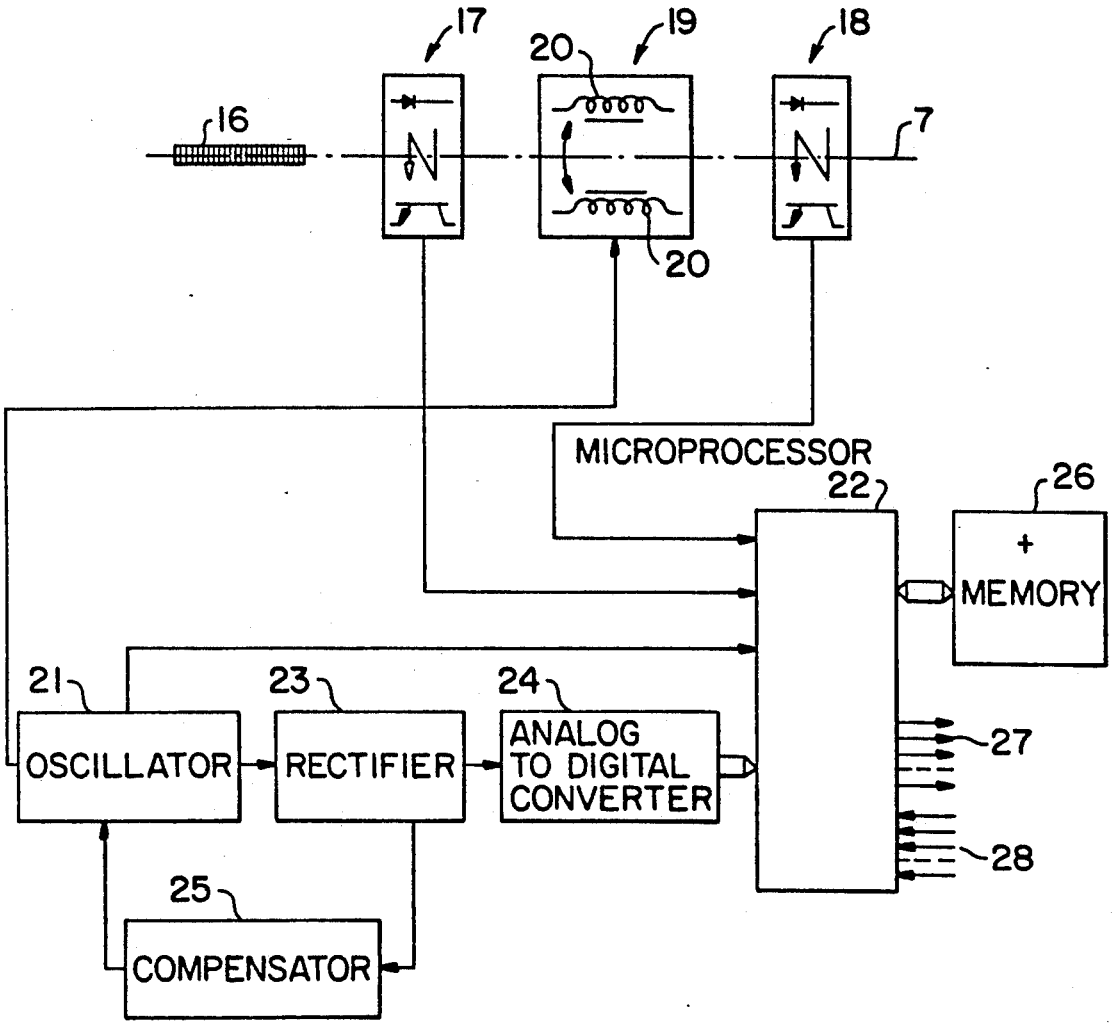
FIG. 4 PRIOR ART
FIG. 4 is the wiring diagram of a selector which can be used to carry out the procedure according to the invention.

Spanish patent 555.181 of the same applicants refers to a coin selector of the type illustrated in FIGS. 1 to 3, which includes in the passage 7 two types of sensors of different kinds, as will be described below with reference to FIG. 4.

This figure indicates with the reference 16 a coin passing along the route or trajectory 7. Along this trajectory are two optical control areas with the numbers 17 and 18, between which is an electromagnetic measurement area 19.

Control areas 17 and 18 preferably consist of phototransistor based sensors, while the electromagnetic measurement area 19 will consist of a pair of electromagnetic inductors 20.

In the pair of optical sensors 17, one of the components is of the fixed side 8 and the other on side 9. The same applies to the pair of optical sensors 18 and the pair of electromagnetic inductors 20.

With this arrangement, when a coin 16 passes along the channel or trajectory 7, it first intercepts the beam of the pair of sensors 17; immediately afterwards it intercepts the electromagnetic field created by the inductors 20 and, finally, it will intercept the optical beam of the pair of sensors 18.

If the coin return button is pressed this causes, by means of lever 13, the rotation of the mobile side g, which moves away from the fixed side 8, opening up the channel 7. As side g moves away from side 8, the distance between the pairs of optical sensors and the pairs of electromagnetic sensors in areas 17, 18 and 19 will alter. This alteration, at least in part of the initial travel, will not alter the operating conditions of the optical sensors 17 and 18, consisting of an emitting photo-diode and receiving photo-transistor pair, since they are strongly saturated, whilst on the other hand the pair of inductors 20 will cause a considerable change in the operating conditions of the oscillator 21 supplying them since the coupling between them depends on their separation. The change experienced by the oscillator 21 will be translated into amplitude or frequency changes, these parameters being measured by the microprocessor 22 of the coin selection system. This system can be completed with a rectifier 23, an analog-digital converter 24, an automatic compensator 25, a memory 26 and identification and control signal outputs 27 and control inputs 28.

Therefore, it is possible to detect the opening of the coin return system resulting in the alteration of the operating conditions of the electromagnetic system, together with the nonalteration of the optical sensors (or the non-insertion of coins) generating the consequent signal for use by the coin machine or equipment associated with it.

In view of the great sensitivity of the inductors 20 to changes in the distance separating them, we can precisely establish the separation (opening) at which it is wished to generate the coin return signal in question.

The procedure according to the invention will therefore be applied to selectors which include at least one coin detector which is sensitive to the opening of the channel or separation between the sides 8 and 9 delimiting it. Preferably, the procedure is applicable to selectors which include at least one input detector not sensitive to the separation or opening of the channel, at least in its initial opening, and a second detector which is sensitive to this separation or opening, so that when a coin passes there is a sequence of passage thereof, and when the channel opens this sequence of passage is absent.

We claim:

1. A procedure for detecting the operation of a coin return mechanism in a coin-operated device, the device having an opening for the insertion of coins, a passage through which the coins pass, said passage including a movable portion operable in response to the actuation of said coin return mechanism for releasing coins stuck in the passage, and a plurality of sensors for detecting the passage of coins and the operation of the coin return mechanism, the procedure comprising the steps of:

providing a plurality of sensors in the coin passage, including at least one sensor for detecting characteristics of a coin passing through said coin passage, and at least one other sensor for detecting characteristics of a coin and for indicating operation of the coin return mechanism by detecting movement of a portion of said coin passage, wherein said one sensor detects the characteristics of a coin but is substantially unaffected by the operation of said coin return mechanism; and processing an output signal of said other sensor in combination with an output signal of said one sensor to determine whether said coin return mechanism has been actuated.

2. A procedure according to claim 1, wherein said other sensor is an inductive sensor.

3. A procedure according to claim 1, wherein said other sensor is a capacitive sensor.

4. A procedure according to claim 1, wherein said one sensor includes an optical sensor.

5. A procedure according to claim 4, wherein a plurality of said optical sensors are included in the coin passage.

* * * * *

UNITED STATES PATENT AND TRADEMARK OFFICE

CERTIFICATE OF CORRECTION

PATENT NO. : 5,322,153

DATED : June 21, 1994

INVENTOR(S) : Jesús E. Ibarrola et al.

It is certified that error appears in the above-identified patent and that said Letters Patent is hereby corrected as shown below:

Col. 3, line 16, "of" should be --on--.

Col. 3, line 27, "g" should be --9--.

Col. 3, line 29, "g" should be --9--.

Signed and Sealed this

Thirtieth Day of August, 1994

Bruce Lehman

*Attest:*

BRUCE LEHMAN

*Attesting Officer*

*Commissioner of Patents and Trademarks*